US009744794B2

(12) United States Patent
Kuehn et al.

(10) Patent No.: US 9,744,794 B2
(45) Date of Patent: Aug. 29, 2017

(54) FILE FOLDER

(71) Applicant: Target Brands, Inc., Minneapolis, MN (US)

(72) Inventors: Thomas P. Kuehn, St. Louis Park, MN (US); Katherine E. Larson, Minneapolis, MN (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

(21) Appl. No.: 14/986,998

(22) Filed: Jan. 4, 2016

(65) Prior Publication Data

US 2016/0114615 A1 Apr. 28, 2016

Related U.S. Application Data

(62) Division of application No. 13/866,542, filed on Apr. 19, 2013, now Pat. No. 9,254,703.

(51) Int. Cl.
*B42F 7/08* (2006.01)
*B42F 7/04* (2006.01)

(52) U.S. Cl.
CPC ..... *B42F 7/08* (2013.01); *B42F 7/04* (2013.01); *B42P 2241/02* (2013.01)

(58) Field of Classification Search
CPC ..... B42F 7/08; B42F 7/06; B42P 2241/02
USPC ..... 229/67.3, 67.4, 928, 311, 77, 67.1; 383/120; 206/425
See application file for complete search history.

(56) References Cited

U.S. PATENT DOCUMENTS

| | | | | |
|---|---|---|---|---|
| 193,340 | A | 7/1877 | Lothrop | |
| 554,574 | A | 2/1896 | Bennett | |
| 2,105,163 | A | 1/1938 | Scandore | |
| 2,280,889 | A | 4/1942 | Buxton | |
| 3,224,661 | A | 12/1965 | Tilton, Jr. | |
| 3,312,384 | A | 4/1967 | Heynemann | |
| 4,260,055 | A | 4/1981 | Slaybaugh | |
| 4,463,848 | A | 8/1984 | Parker | |
| D283,561 | S | 4/1986 | Geist | |
| 4,802,602 | A * | 2/1989 | Evans | B65D 81/3886 220/739 |
| 4,966,318 | A | 10/1990 | Dutka | |
| 5,170,889 | A | 12/1992 | Cue | |
| 5,387,037 | A | 2/1995 | Daitch | |
| D359,310 | S | 6/1995 | Su | |
| 5,593,086 | A | 1/1997 | Ho | |
| 5,788,073 | A | 8/1998 | Suryk | |
| 5,947,279 | A | 9/1999 | Lee et al. | |
| 6,047,879 | A | 4/2000 | Henrikson et al. | |
| 6,354,486 | B1 | 3/2002 | Ho | |
| 6,502,742 | B1 | 1/2003 | Su | |
| 6,558,063 | B2 | 5/2003 | Ho | |
| 6,607,122 | B1 | 8/2003 | Ong | |
| 6,837,368 | B1 | 1/2005 | Chang | |

(Continued)

*Primary Examiner* — Christopher Demeree
(74) *Attorney, Agent, or Firm* — Leanne Taveggia Farrell; Westman, Champlin & Koehler, P.A.

(57) ABSTRACT

A file folder includes a rotatable cover and a closure mechanism. The closure mechanism secures the rotatable cover against a front of the file folder to maintain the file folder in a closed position. The closure mechanism further secures the rotatable cover against a back of the file folder to maintain the file folder in an opened position. The closed position protects contents of the file folder, while the opened position allows access to the contents of the file folder.

20 Claims, 15 Drawing Sheets

(56) References Cited

U.S. PATENT DOCUMENTS

| | | | | |
|---|---|---|---|---|
| 6,865,367 | B2 | 3/2005 | Kim et al. | |
| 6,880,747 | B1 | 4/2005 | Pelleg | |
| 6,945,399 | B1 | 9/2005 | Ong | |
| 7,201,528 | B1 | 4/2007 | Swegart | |
| 7,306,134 | B1 | 12/2007 | Ong | |
| D590,016 | S | 4/2009 | Weinstein | |
| 7,597,192 | B2 * | 10/2009 | Lee | B42F 7/08 206/232 |
| 7,644,857 | B2 | 1/2010 | Chou | |
| 7,909,234 | B2 | 3/2011 | Maistrellis | |
| 8,038,052 | B2 | 10/2011 | Huang | |
| 8,118,165 | B2 | 2/2012 | Duvekot et al. | |
| 2003/0201312 | A1 | 10/2003 | Lee | |
| 2006/0108403 | A1 | 5/2006 | Ho | |
| 2007/0012752 | A1 | 1/2007 | Lee | |
| 2007/0114258 | A1 | 5/2007 | Miller | |
| 2007/0235506 | A1 | 10/2007 | Shapiro | |
| 2010/0116873 | A1 | 5/2010 | Dodson et al. | |
| 2012/0057925 | A1 | 3/2012 | Baker et al. | |
| 2012/0111930 | A1 | 5/2012 | Maistrellis | |

* cited by examiner

100

126
132
124
112
100

124
116
118
132
134
130
112
102
122
100

122
112
102
130
132
134
130
118
124
116
100

112
140
132
102

FILE FOLDER

CROSS-REFERENCE TO RELATED APPLICATION

The present application is a divisional of and claims priority to U.S. patent application Ser. No. 13/866,542, filed Apr. 19, 2013, the contents of which are hereby incorporated by reference in their entirety.

BACKGROUND

File folders provide a way for a person to carry documents and the like in an organized, secured, protected and accessible manner. File folders can include a bottom, expandable sides, a top flap and dividers for containing the documents. File folders can also include various accessory pockets and pouches for holding additional items.

The discussion above is merely provided for general background information and is not intended to be used as an aid in determining the scope of the claimed subject matter.

SUMMARY

A file folder includes a rotatable cover having clasp that includes a first end protruding from a first side of the rotatable cover and a second end protruding from a second side of the rotatable cover. A loop is slidable within a plurality of holes in the file folder. When the loop is pulled in a first direction through at least two of the plurality of holes the loop engages with the first end of the clasp to secure the rotatable cover against the front of the file folder. When the loop is pulled in a second direction through at least two of the plurality of holes the loop engages with the second end of the clasp to secure the rotatable cover against the back of the file folder. The second direction is different from the first direction.

A file folder includes a fixed section having fixed dimensions and is defined by a closed bottom, an open top; and a fixed partition separating the closed bottom from the open top. At least one pull-out drawer is slidable between a position located between the fixed partition and the closed bottom of the fixed section and a position that protrudes outwardly from a side of the fixed section. The fixed section also includes a storage compartment located between the fixed partition and the open top.

A file folder includes a rotatable cover having a through cut that defines a closure tab, a front slot extending through a front of the file folder and a back slot extending through a back of the file folder. The front slot is configured to receive the closure tab to secure the rotatable cover in a closed position. The back slot is configured to receive the closure tab to secure the rotatable cover in an opened position.

A method of accessing contents of a file folder is provided. The method includes releasing a loop that is engaged around a first end of a clasp that is coupled to a rotatable cover on a file folder. The first end of the clasp protrudes from a first side of the rotatable cover. The rotatable cover is rotated from a closed position to an opened position. The loop is pulled in a first direction through at least two of a plurality of holes in the file folder. The loop is engaged around a second end of the clasp that protrudes from a second side of the rotatable cover to secure the rotatable cover in the opened position.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

A file folder includes a rotatable cover and a closure mechanism. The closure mechanism secures the rotatable cover against a front of the file folder to maintain the file folder in a closed position to protect contents of the file folder. In the alternative, the closure mechanism secures the rotatable cover against a back of the file folder to maintain the file folder in an opened position to allow access to the contents of the file folder. In one embodiment, the closure mechanism includes a double-sided clasp and a slidable loop to both hold the file folder in the closed position and in the opened position. In another embodiment, the closure mechanism includes a tab and two different slots for receiving the tab.

Figure 1:
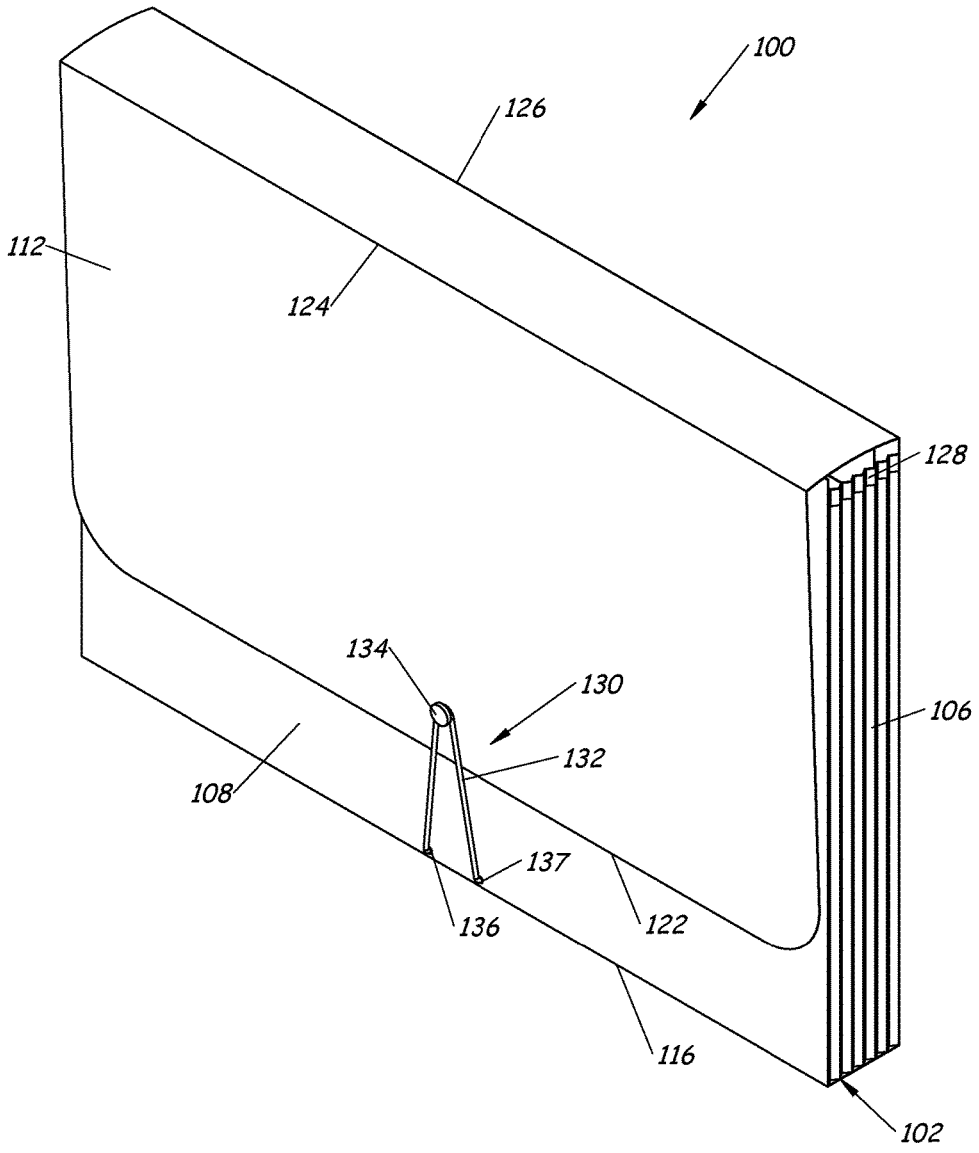
FIG. 1 is a perspective view of a file folder in a closed position according to one embodiment.
Figure 2:
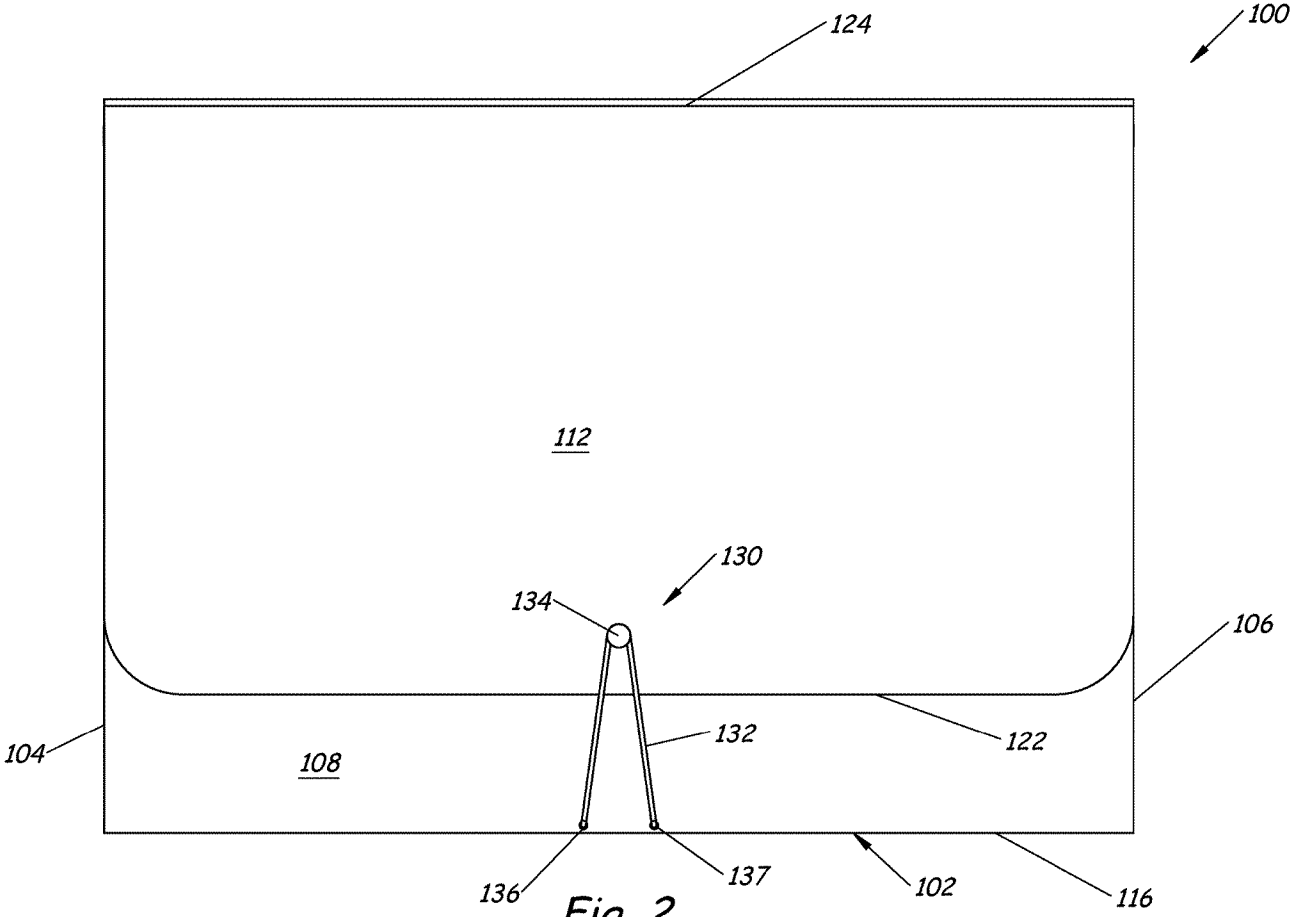
FIG. 2 is a front view of the file folder of FIG. 1.

FIG. 1 is a perspective view of a file folder 100 in a closed position according to one embodiment. A front view, a back view, a left side view (a right side view being a mirror image), a top view and a bottom view of the closed position are illustrated in FIGS. 2-6. File folder 100 includes a bottom 102, a pair of opposing sides 104 and 106, a front 108, a back 110 and a top flap or rotatable cover 112. In one embodiment and as illustrated in FIGS. 1-6, file folder 100 can be made of a polymer material, such as a polyolefin or polyester. However, other similar materials with similar properties, such as recyclable materials including cardboard, can be used. More particularly, bottom 102, front 108, back 110 and top flap or rotatable cover 112 can be made of a rigid polymer, while the pair of opposing sides 104 and 106 can be made of a more flexible polymer. This can be accomplished by using the same or different polymers throughout file folder 100 or by making the more rigid structural pieces of file folder 100 thicker than the more flexible structural pieces.

Figure 3:
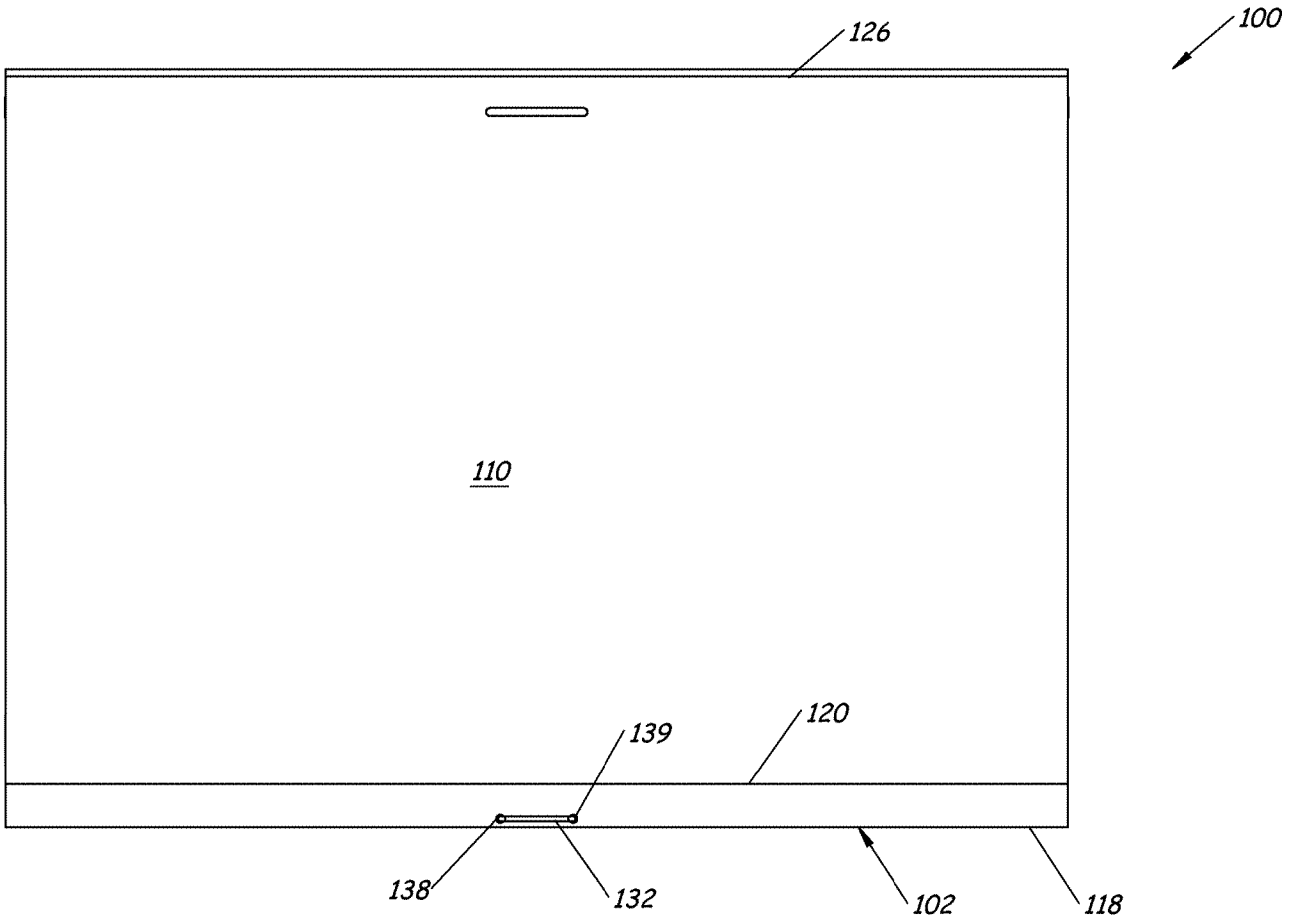
FIG. 3 is a back view of the file folder of FIG. 1.

In one embodiment and as illustrated in FIGS. 1-6, bottom 102 and front 108 are made of a single, continuous piece of material that includes a front free end 114 (FIG. 4), a first bend 116 (FIGS. 1 and 2), a second bend 118 (FIG. 3) and a back end 120 (FIG. 3). For example, the single, continuous piece of material of bottom 102 and front 108 can be made of an opaque polymer having rigid characteristics where an area between front free end 114 and first bend 116 defines front 108 and an area between first bend 116 and second bend 118 defines bottom 102. In one embodiment and as illustrated in FIGS. 1-6, back 110 and top flap or rotatable cover 112 are made of a single, continuous piece of material that includes a free end 122 (FIGS. 1 and 2), a first bend 124 (FIGS. 1 and 2), a second bend 126 (FIGS. 1 and 3) and a back end (hidden from view but terminates under the single, continuous piece of material of bottom 102 and front 108 near second bend 118). For example, the single, continuous piece of material of back 110 and top flap or rotatable cover 112 can be made of a translucent polymer having rigid characteristics where an area between free end 122 and second bend 126 defines top flap or rotatable cover 112 and an area between second bend 126 and the back end defines back 110. More particularly, top flap or rotatable cover 112 is rotatable about second bend 126.

Figure 4:
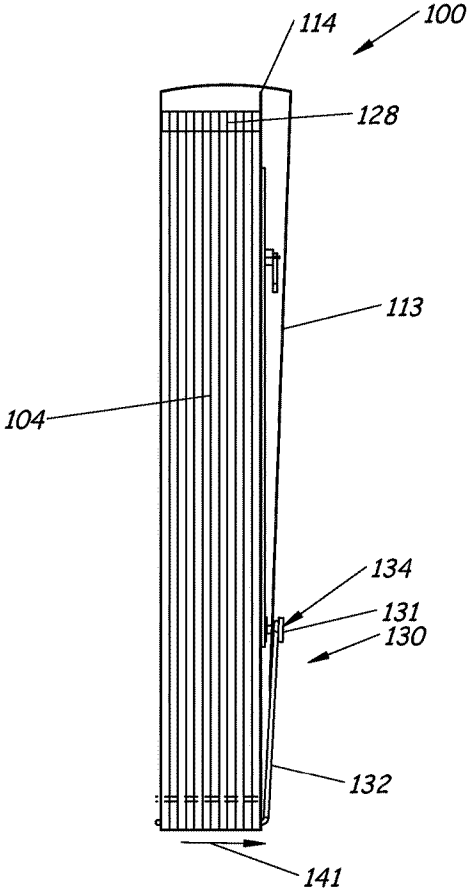
FIG. 4 is a side view of the file folder of FIG. 1.

In one embodiment, the pair of opposing sides 104 and 106 are made of a more flexible polymer than the single, continuous piece of front 108 and bottom 102 and the single, continuous piece of back 110 and top flap 112. In another embodiment, the pair of opposing sides 104 and 106 are gusseted so that file folder 100 is an expandable file folder. Gusseted in this context means that opposing sides 104 and 106 are folded, creased or otherwise hinged into triangular shapes, much like an accordion pleat, to provide the pair of opposing sides 104 and 106 with the ability to decrease in dimension and to increase in dimension. As illustrated in FIGS. 1 and 4, the pair of opposing sides 104 and 106 can be reinforced at their tops with nylon edging 128. Together, bottom 102, the pair of opposing sides 104 and 106, front 108, back 110 and top flap or rotatable cover 112 house a plurality of dividers 129 and therefore define spaces between the plurality of dividers 129 where documents can be stored. As documents are added to file folder 100, the distance between front 108 and back 110 can change using the gussets of the pair of opposing sides 104 and 106 to accommodate the added documents.

Figure 7:
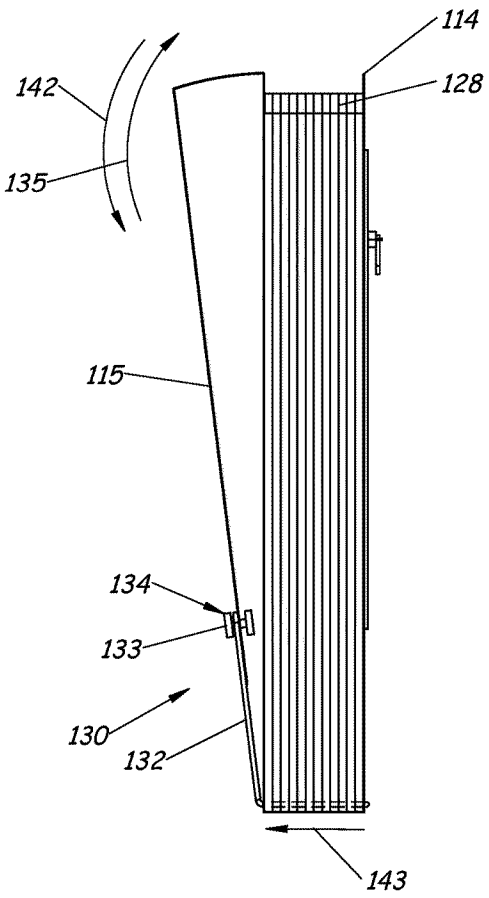
FIG. 7 is a side view of the file folder of FIG. 1, but in an opened position according to another embodiment.
Figures 5, 6, 9, 10:
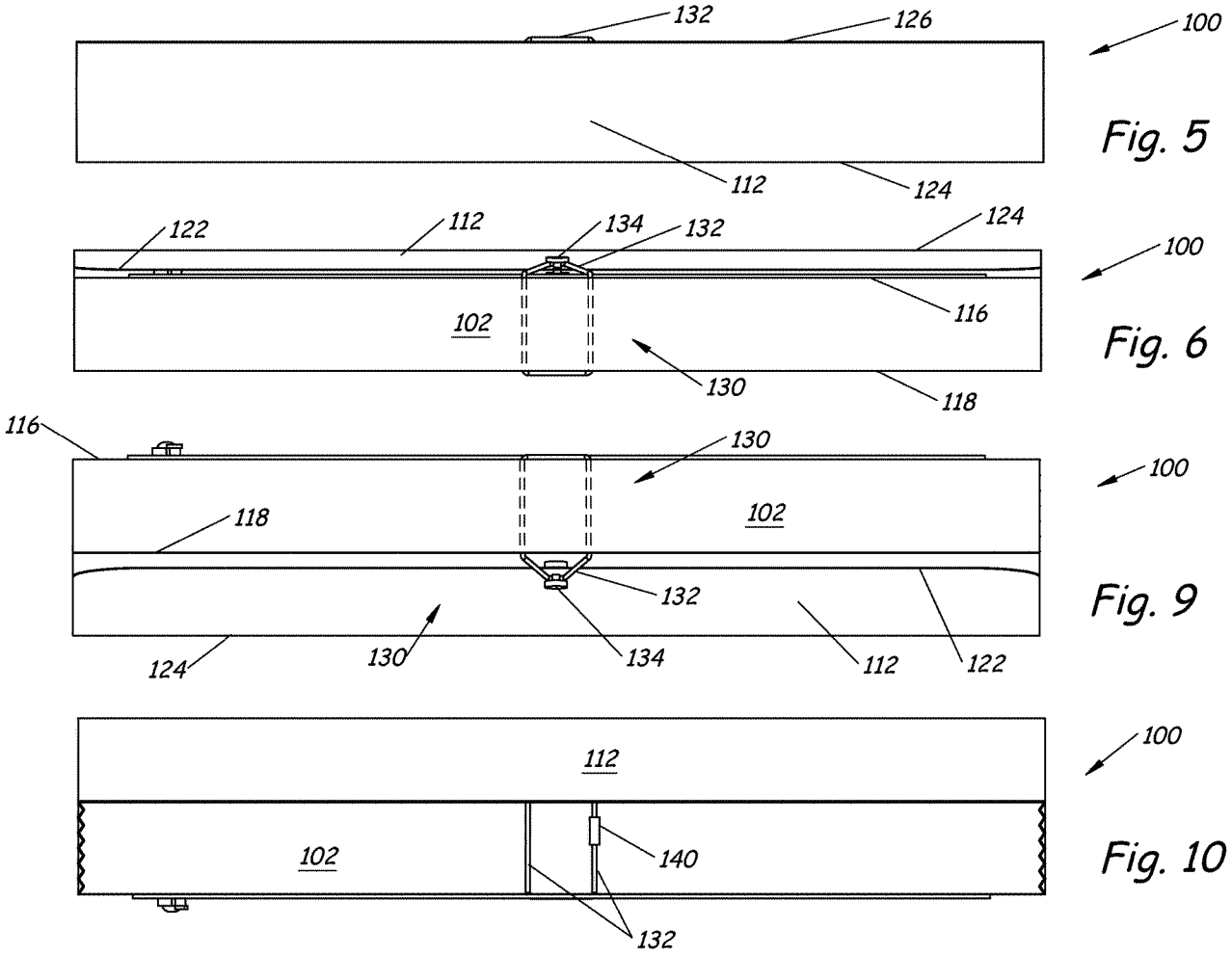
FIG. 5 is a top view of the file folder of FIG. 1.
FIG. 6 is a bottom view of the file folder of FIG. 1.
FIG. 9 is a bottom view of the file folder of FIG. 1, but in the opened position illustrated in FIG. 7.
FIG. 10 is a top view of the file folder of FIG. 1, but in the opened position illustrated in FIG. 7 and with dividers removed.
Figure 8:
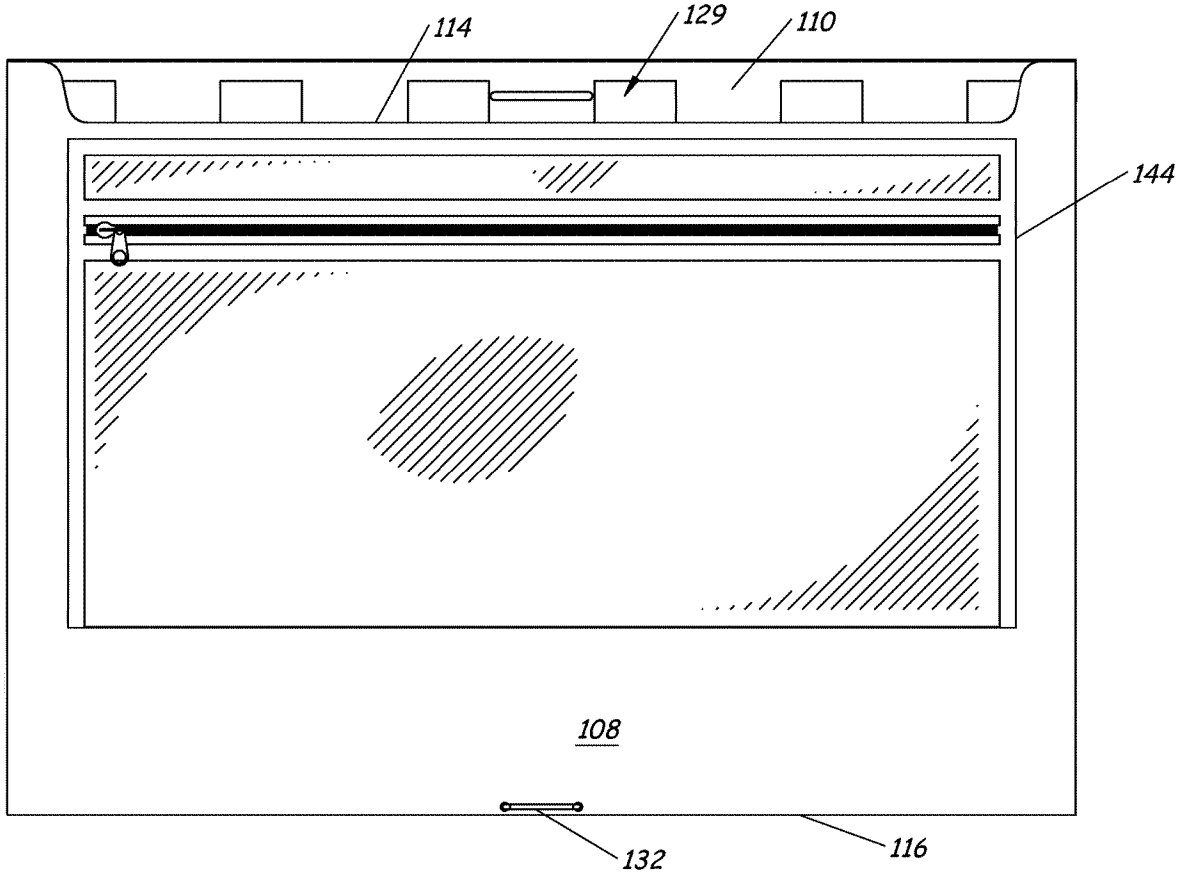
FIG. 8 is a front view of the file folder of FIG. 1, but in the opened position illustrated in FIG. 7.

File folder 100 also includes a closure 130 that includes a loop 132 and a clasp 134. Loop 132 is made of an elastic cord material that can be stretched to engage with clasp 134, but is also capable of returning to its original shape after being disengaged. Clasp 134 is attached to top flap or rotatable cover 112 and includes a first end 131 (FIG. 4) protruding from a first or exterior side 113 (FIG. 4) of top flap or rotatable cover 112 and a second end 133 (FIG. 7) protruding from a second or interior side 115 (FIG. 7) of top flap or rotatable cover 112. Closure 130 provides a mechanism that secures top flap or rotatable cover 112 in either a closed position as illustrated in FIGS. 1-6 or in an opened position as illustrated in FIGS. 7-10. FIG. 7 is a side view of file folder 100 in the opened position. A front view, a bottom view and a top view (with dividers 129 removed) of file folder 100 in the opened position are illustrated in FIGS. 8-10, respectfully.

In one embodiment and as illustrated, front 108 includes a pair of through holes 136 and 137 for receiving loop 132 and back 110 includes a pair of through holes 138 and 139 for receiving loop 132. Through holes 136 and 137 are centrally located on front 108 and adjacent to first bend 116 and through holes 138 and 139 are centrally located on back 110 and adjacent to second bend 118. Through hole 136 is spaced apart from through hole 137 and is in alignment with through hole 138. Through hole 137 is in alignment with through hole 139, which is spaced apart from through hole 138. Loop 132 includes two ends that are connected together by a crimp tube 140. During assembly of file folder 100, one of the ends of loop 132 is threaded through holes 136, 138, 139 and 137. The opposing end is attached to the end that was threaded through the holes using crimp tube 140. Crimp tube 140 is illustrated in FIG. 10, which is a top view of file folder 100 in the opened position. Crimp tube 140 is pushed through one of the through holes 136, 138, 139 or 137 and is housed within the interior of file folder 100.

Loop 132 is slidable within at least two of the plurality of holes 136, 137, 138 and 139. When top flap or rotatable cover 112 is in a closed position as illustrated in FIGS. 1-6, loop 132 is pulled through at least two of the plurality of holes 136, 137, 138 and 139 in a first direction 141 (FIG. 4) and is looped around or engaged with first end 131 of clasp 134 to secure top flap or rotatable cover 112 against front 108 of file folder 100. This forward position of continuous loop 132 is illustrated in solid lines in FIGS. 4 and 6 where continuous loop 132 lies outside of file folder 100 and in phantom lines where continuous loop 132 lies inside of file folder 100. To place file folder 100 in an opened position, loop 132 is released from first end 131 of clasp 134 and top flap or rotatable cover 112 is rotated about second bend 126 in a direction 142 as illustrated in FIG. 7. To secure top flap or rotatable cover 112 in the opened position, loop 132 is pulled through at least two of the plurality of holes 136, 137, 138 and 139 in a second direction 143 (FIG. 7) and is looped around or engaged with a second end 133 of clasp 134 to secure top flap or rotatable cover 112 against back 110 of file folder 100. Second direction 143 is different from first direction 141 and, in one embodiment, second direction 143 is opposite first direction 141. This backward position of loop 132 is illustrated in solid lines in FIGS. 7 and 9 where loop 132 lies outside of file folder 100 and in phantom lines where loop 132 lies inside of file folder 100.

Likewise, to place file folder 100 back in a closed position, loop 132 is released from second end 133 of clasp 134 and top flap or rotatable cover 112 is rotated about second bend 126 in a direction 135 (FIG. 7). To reclose top flap or rotatable cover 112, loop 132 is pulled through at least two of the plurality of holes 136, 137, 138 and 139 in first direction 141 and is looped around or engaged with second end 133 of clasp 134 to again secure top flap or rotatable cover 112 against front 108 of file folder 100. Closure 130 uses the same two components (loop 132 and clasp 134) for both securing file folder 100 closed to protect documents and for securing file folder 100 open to access documents.

In one embodiment, front 108 of file folder 100 includes a pocket 144. In the embodiment illustrated in FIGS. 1-10, pocket 144 is a zippered pouch 144 and is best illustrated in FIG. 8. Pocket or pouch 144 is located on front 108 behind top flap or rotatable cover 112 when file folder 100 is in a closed position, but is accessible for use on front 108 when file folder 100 is in an opened position. As illustrated, the edges of pouch 144 are reinforced with nylon and the pouch is made of a transparent polymer of a flexible nature. In this way, items held in pouch 144 are made easily visible to a user of expandable file or folder 100 without the user having to dig through pouch 144 to find what they need. Pouch 144 is designed to store accessory items. For example, pouch 144 can store writing utensils, labels for dividers 129 and other office supplies, such as paperclips, flash drives and the like.

Figure 11:
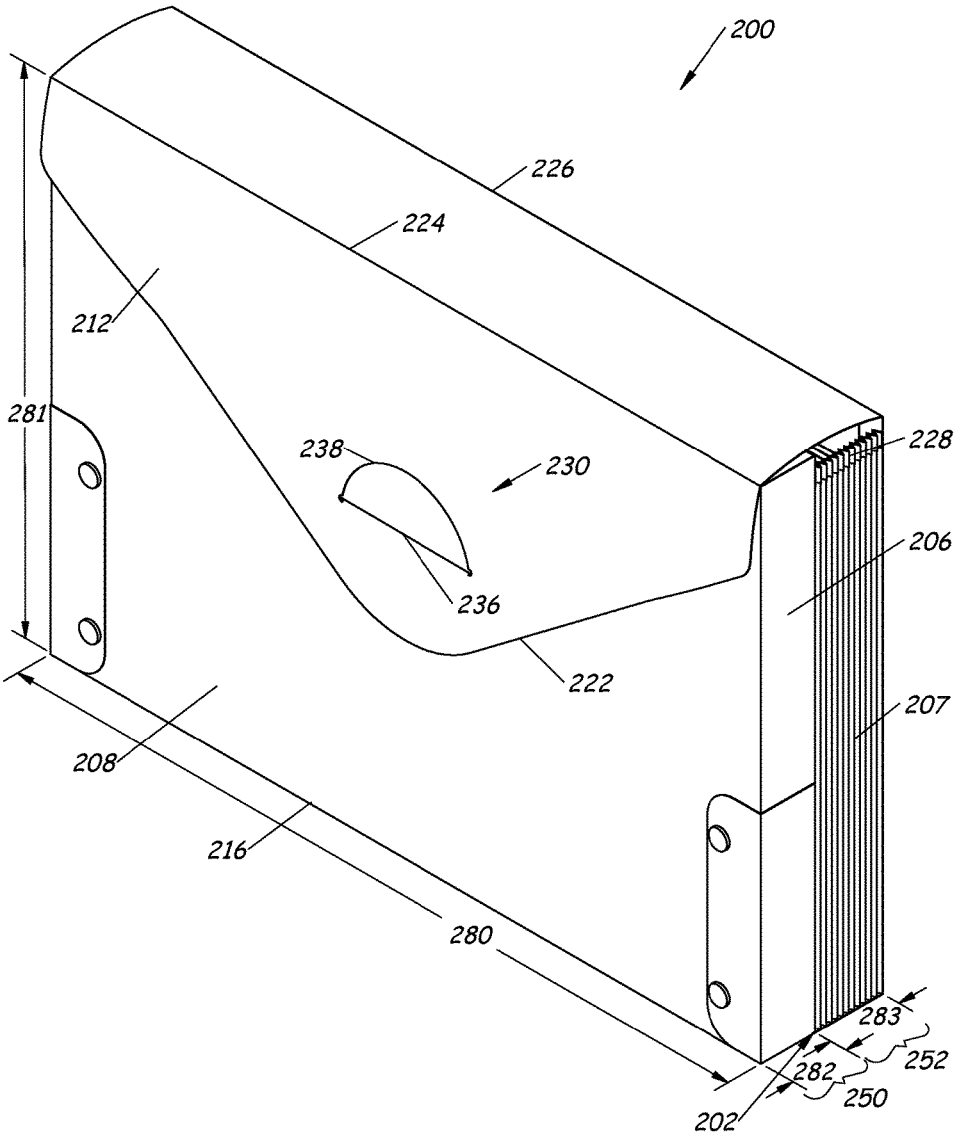
FIG. 11 is a perspective view of a file folder in a closed position according to yet another embodiment.
Figure 12:
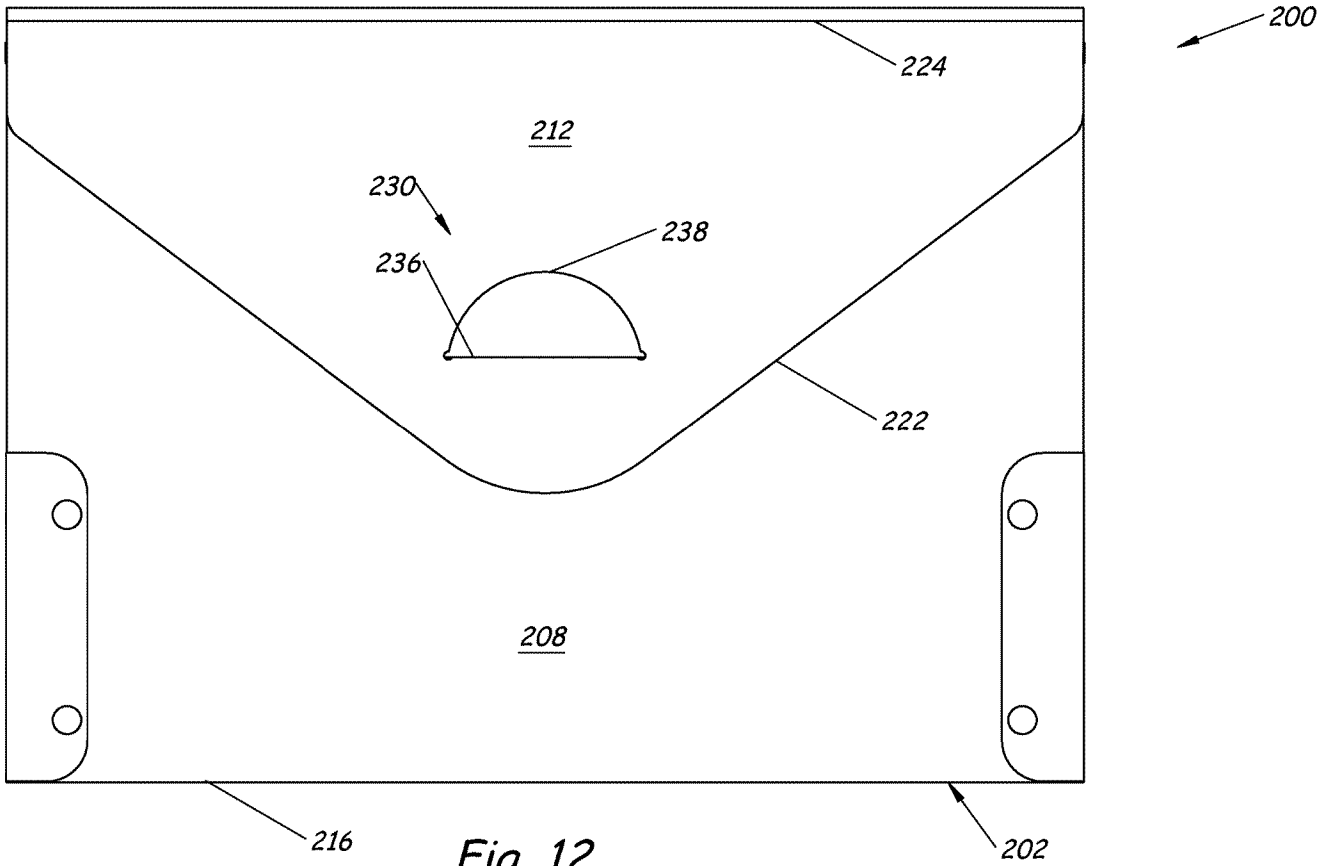
FIG. 12 is a front view of the file folder of FIG. 11.
Figure 15:
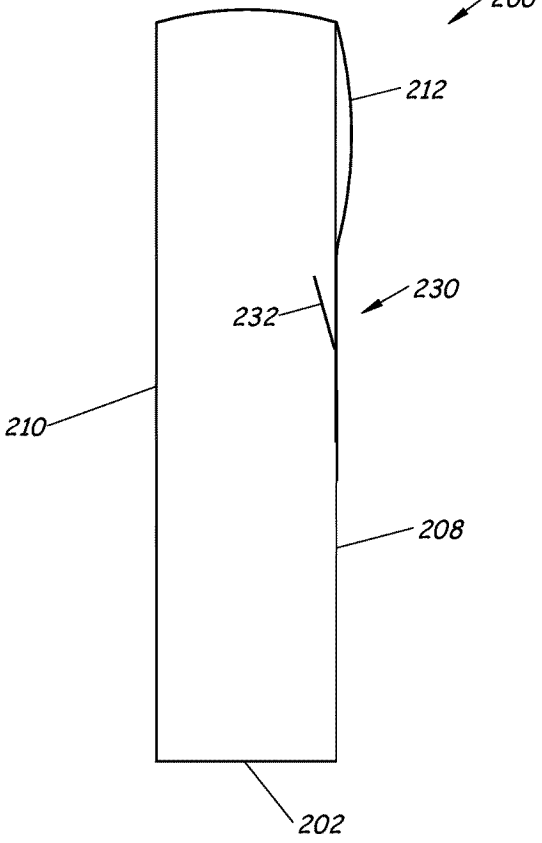
FIG. 15 is a diagrammatic side view of the file folder of FIG. 11.

FIG. 11 is a perspective view of a file folder 200 in a closed position according to yet another embodiment. A front view, a back view, a left side view (a right side view being a mirror image), a top view and a bottom view of file folder 200 in the closed position are illustrated in FIGS. 12-14 and 16-17, respectfully. FIG. 15 is a diagrammatic side view of file folder 200 and will be discussed in detail below. File folder 200 includes a bottom 202, a front 208, a back 210 and a top flap or rotatable cover 212. Furthermore and in one embodiment, file folder 200 includes a fixed section 250 and an expandable section 252. Fixed section 250 has fixed dimensions including a fixed length 280, a fixed height 281 and a fixed depth 282. Expandable section 252 includes at least one dimension that changes. For example, expandable section 252 can includes an unfixed depth 283. Front 208 is not only the front of file folder 200, but is also the front of fixed section 250. Fixed section 250 also includes a pair of opposing sides 204 and 206, an open top and a closed bottom, which is part of bottom 202. Back 210 is not only the back of file folder 200, but is also the back of expandable section 252. Expandable section 252 also includes a pair of opposing sides 205 and 207, an open top and a closed bottom, which is part of bottom 202.

In one embodiment and as illustrated in FIGS. 11-14 and 16-17, file folder 200 can be made of a polymer material, such as a polyolefin or polyester. However, other similar materials with similar properties, such as recyclable materials including cardboard, can be used. More particularly, bottom 202, front 208, back 110, top flap or rotatable cover 212 and the structural pieces of fixed section 250 can be made of a rigid polymer, while the pair of opposing sides 205 and 207 of expandable section 252 can be made of a more flexible polymer. This can be accomplished by using the same or different polymers throughout expandable file or folder 200 or by making the more rigid structural pieces of file or folder 200 thicker than the more flexible structural pieces.

Figure 13:
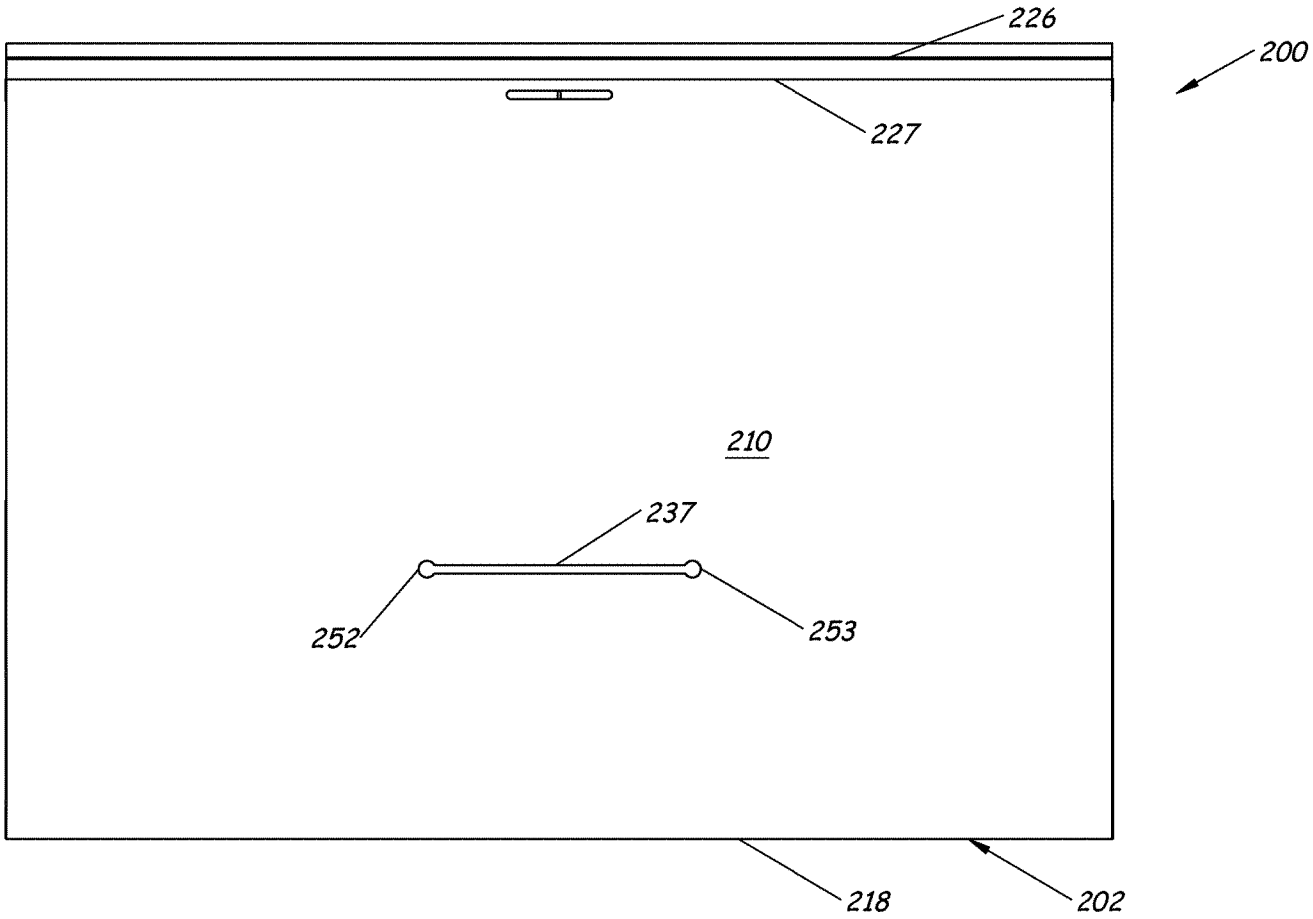
FIG. 13 is a back view of the file folder of FIG. 11.

In one embodiment and as illustrated in FIGS. 11-14 and 16-17, top flap or rotatable cover 212 is made of a single, continuous piece of material that includes a front free end 222 (FIGS. 11 and 12), a first bend 224 (FIGS. 11 and 12), a second bend 226 (FIGS. 11 and 13) and a back end 227 (FIG. 13). For example, the single, continuous piece of material of top flap or rotatable cover 212 can be made of a rigid translucent polymer. In one embodiment and as illustrated in FIGS. 11-14 and 16-17, bottom 202, front 208 and back 210 are made of a single, continuous piece of material that includes a front free end 214 (FIG. 14), a first bend 216 (FIGS. 11 and 12), a second bend 218 (FIG. 13) and a back end (hidden from view but terminates under the single, continuous piece of material of top flap 212 near second bend 226). For example, the single, continuous piece of material of bottom 202, front 208 and back 210 can be made of a rigid opaque polymer where an area between front free end 214 and first bend 216 defines front 208, an area between first bend 216 and second bend 218 defines bottom 202 and an area between second bend 218 and the back end defines back 210. Structural components of fixed section 250 and expandable section 252 will be discussed in detail below.

Figure 19:
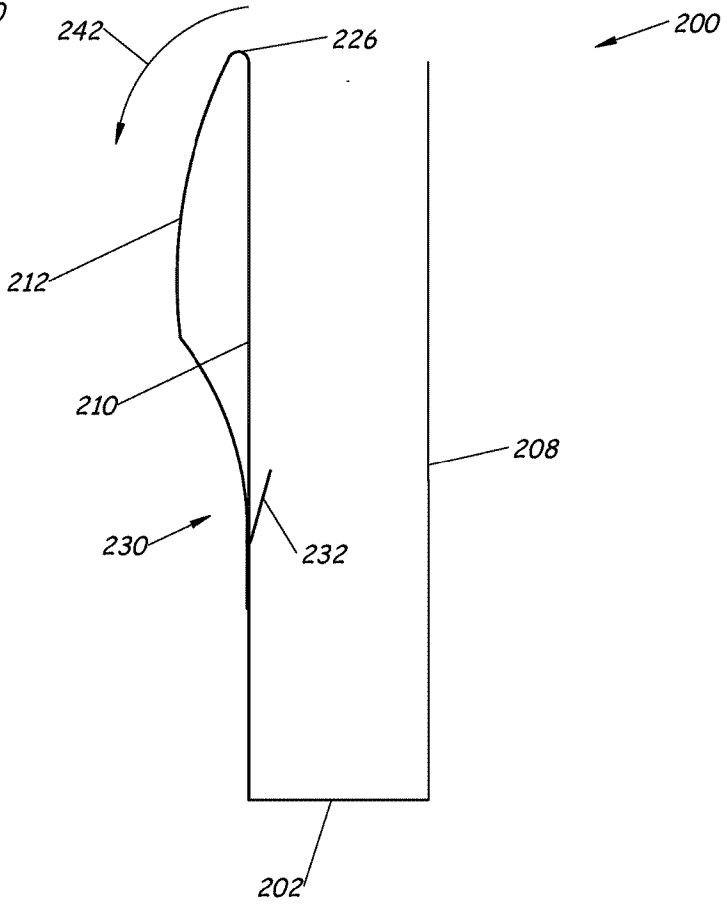
FIG. 19 is a diagrammatic side of the file folder of FIG. 18.
Figure 18:
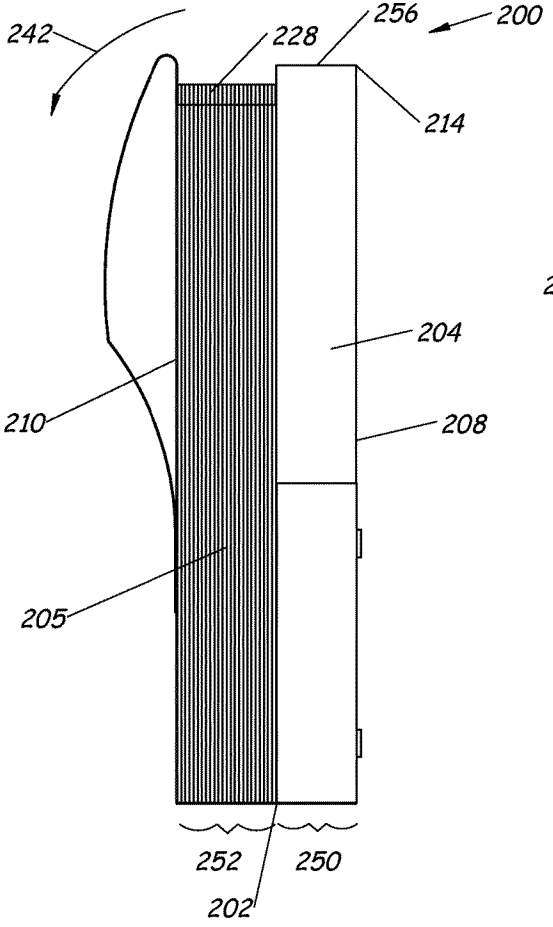
FIG. 18 is a side view of the file folder of FIG. 11, but in an opened position according to yet another embodiment.
Figure 20:
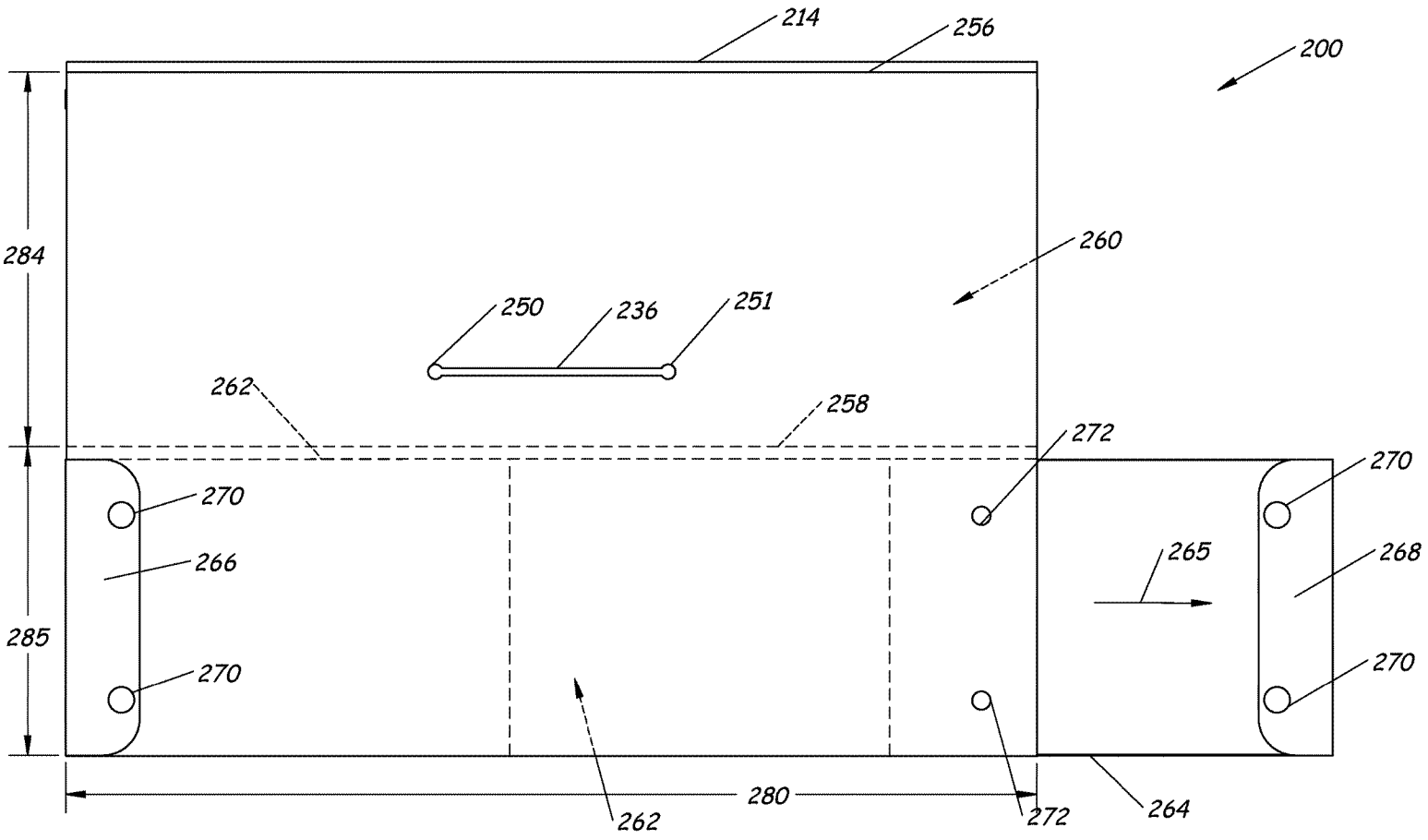
FIG. 20 is a front view of the file folder of FIG. 11, but in an opened position and a side drawer opened.
Figure 21:
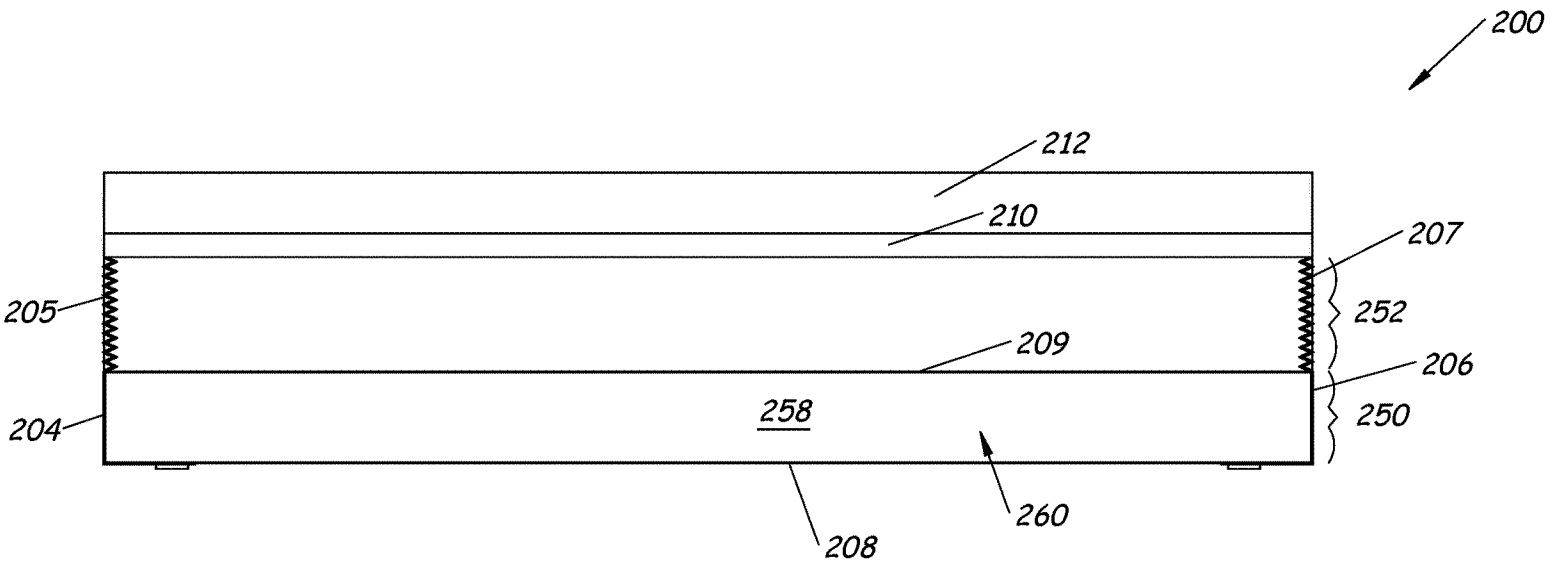
FIG. 21 is a top view of the file folder of FIG. 11, but in the opened position illustrated in FIG. 18.
Figure 22:
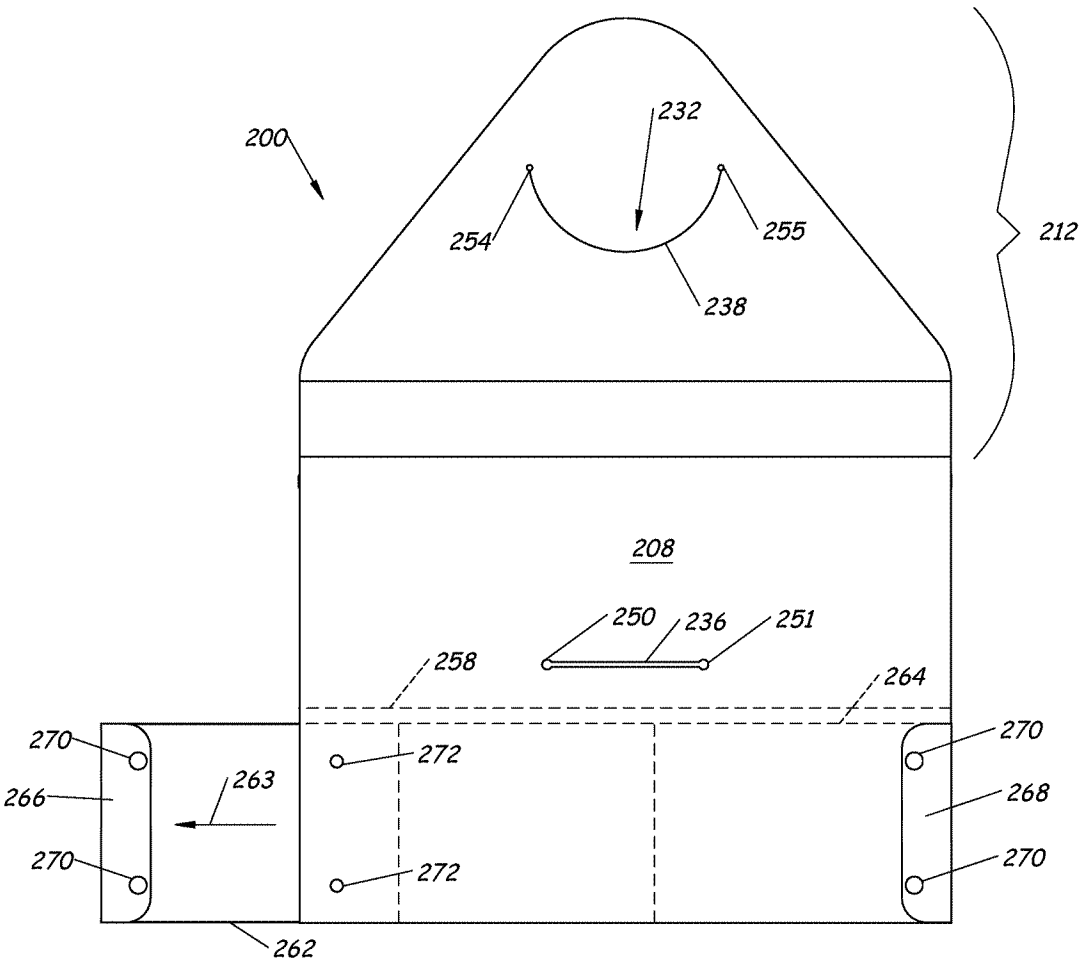
FIG. 22 is a front view of the file folder of FIG. 11, but with the top flap only partially opened and a side drawer opened.

File folder 200 also includes a closure 230 that includes a closure tab 232 (FIG. 22) that is formed integrally with top flap or rotatable cover 212, a front slot 236 and a back slot 237. Closure 230 provides a mechanism that secures top flap or rotatable cover 212 in either a closed position as illustrated in FIGS. 11-17 or in an opened position as illustrated in FIGS. 18-21. FIG. 18 is a side view of file folder 200 in the opened position. FIG. 19 is a diagrammatic side view of file folder 200 in the opened position. A front view and a top view (with dividers removed) of file folder 200 in the opened position are illustrated in FIGS. 20-21, respectfully. FIG. 22 illustrates a front view of file folder 200, but with top flap or rotatable cover 212 partially open.

In one embodiment and as illustrated, front 208 includes front slot 236 (FIGS. 20 and 22), back 210 includes back slot 237 (FIG. 13) and top flap or rotatable cover 212 includes a through cut 238 (FIGS. 11, 12, 17 and 22). Front slot 236, back slot 237 and through cut 238 are all part of closure 230 where front slot 236 extends through front 208 of file folder 200, back slot 237 extends through back 210 and through cut 238 defines closure tab 232 in top flap or rotatable cover 212. When file folder 200 is in a closed position (as illustrated in FIGS. 11-17), front slot 236 in front 208 receives closure tab 232. When file folder 200 is in an opened position (as illustrated in FIGS. 18-21), back slot 237 in back 210 receives closure tab 232. The diagrammatic views illustrated in FIGS. 15 and 19 illustrate this concept clearly. In FIG. 15, closure tab 232 is inserted through front slot 236 and retains top flap or rotatable cover 212 against front 208 to keep expandable file or folder 200 in the closed position. In FIG. 19, top flap or rotatable cover 212 is rotated about second bend 226 and closure tab 232 is inserted through back slot 237 to retain top flap or rotatable cover 212 against back 210 and keep file folder 200 in the opened position. As illustrated in the diagrammatic side views of FIGS. 15 and 19, when closure tab 232 is inserted through either front slot 236 or back slot 237, the end of closure tab 232 is oriented upwardly.

In one embodiment and as illustrated in FIGS. 20 and 22, front slot 236 includes circular cut outs 250 and 251 at its ends, and as illustrated in FIG. 13, back slot 237 includes circular cut outs 252 and 253 at its ends. Circular cut outs 250 and 251 have substantially similar diameters that are greater than a thickness of front slot 236. Circular cut outs 252 and 253 have substantially similar diameters that are greater than a thickness of back slot 237. Circular cut outs 250, 251, 252 and 253 reduce the stress exerted at ends of front slot 236 and back slot 237 by closure tab 232. In one embodiment and as illustrated in FIG. 22, through cut 238 includes circular cut outs 254 and 255 at its ends. Circular cut outs 254 and 255 have substantially similar diameters and reduce the stress exerted at the ends of through cut 238 when closure tab 232 is inserted into either front slot 236 or back slot 237.

Fixed section 250 includes front 208, a pair of opposing sides 204 and 206, a back 209 (FIG. 21), an open top 256 (FIG. 18) and a closed bottom, which is part of bottom 202. In one embodiment, fixed section 250 further includes a fixed partition 258 that separates the closed bottom from open top 256. More specifically, fixed partition 258 is located between open top 256 and the closed bottom and defines a storage compartment 260 located above partition 258 and a drawer compartment 262 located below partition 258. FIG. 20 illustrates partition 258, storage compartment 260 and drawer compartment 262 in phantom lines, while FIG. 21 illustrates a top view of partition 258 and storage compartment 260.

Storage compartment 260 has a dimensionally fixed volume defined by fixed length 280, fixed depth 282 (FIG. 1) and a fixed height 284 that extends from partition 258 to open top 256 and can hold various accessory items. For example, storage compartment 260 can store writing utensils, labels for dividers located in the expandable section 252 and other office supplies, such as paperclips, flash drives and the like. Drawer compartment 260 also has a dimensionally fixed volume defined by fixed length 280, fixed depth 282 and a fixed height 285 that extends from the closed bottom to partition 258 and is configured to house at least one pull-out drawer. In one embodiment and as illustrated in FIGS. 20 and 22, the at least one pull-out drawer includes a pair of pull-out drawers 262 and 264. Each pull-out drawer 262 and 264 is slidable between a closed position located between fixed partition 258 and the closed bottom of fixed section 250 and an opened position that protrudes outwardly from one of the sides 204 and 206 of fixed section 250. More particularly, pull-out drawer 262 is slidable in a first direction 263 between a closed position located between fixed partition 258 and the closed bottom of fixed section 250 and an opened position that protrudes outwardly from side 204 of fixed section 250. Pull-out drawer 264 is slidable in a second direction 265 between a closed position located between fixed partition 258 and the closed bottom of fixed section 250 and an opened position that protrudes outwardly from side 206 of fixed section 250. First direction 263 is different from second direction 265. In one embodiment, first direction 263 is opposite second direction 265.

When pull-out drawers 262 and 264 are located in the closed positions, they are secured to front 208 of file folder 200 and therefore the front of fixed section 250 by at least one closure. In one embodiment, the at least one closure is a snap. For example and as illustrated in FIGS. 20 and 22, pull-out drawers 262 and 264 include a respective flap 266 and 268. Flaps 266 and 268 are coupled respectively to pull-out drawers 262 and 264 at respective ends of the drawers that are in alignment with sides 204 and 206 of fixed section 250 when the drawers are in closed positions. Coupled to each flap 266 and 268 is at least one female portion 270 of a snap. Coupled to front 208 is at least one corresponding male portion 272 of a snap. Together female portion 270 and male portion 272 engage to hold drawers 262 and 264 in place in a closed position. When female portion 270 and male portion 272 are disengaged, drawers 262 and 264 can be pulled out to extend outwardly from sides 204 and 206 to hold accessory items. For example, drawers 262 and 264 can store writing utensils, labels for dividers located in the expandable section 252 and other loose item office supplies, such as paperclips, flash drives and the like.

As previously described, expandable section 252 is located adjacent to fixed section 250. Expandable section 252 includes back 210, a pair of opposing sides 205 and 207, a front that is the back 209 of fixed section 250, an open top and a closed bottom, which is part of bottom 202. Expandable section 252 includes at least one unfixed dimension. In the embodiment illustrated in FIGS. 11-22, expandable section 252 is unfixed in depth 283 (i.e., the distance between component 209 and back 210). In other words, the depth of expandable section can increase or decrease.

Figure 14:
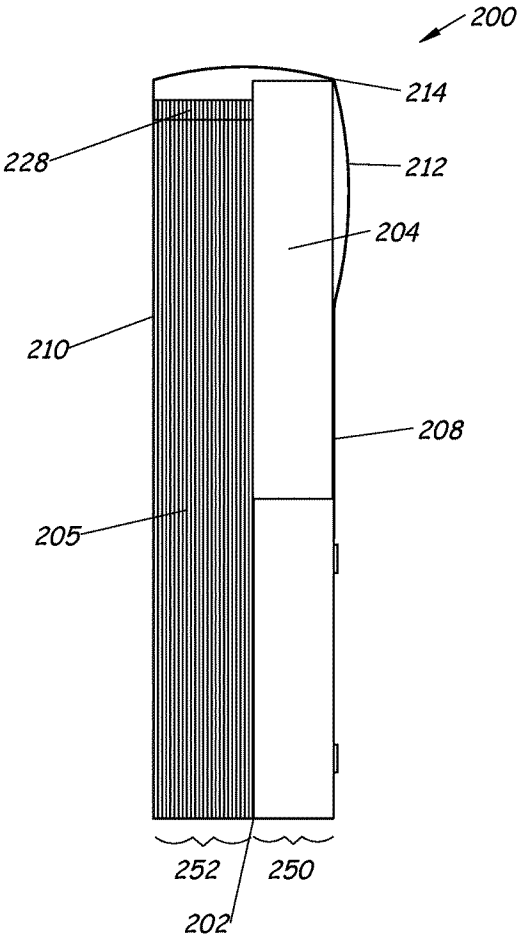
FIG. 14 is a side view of the file folder of FIG. 11.
Figure 16:
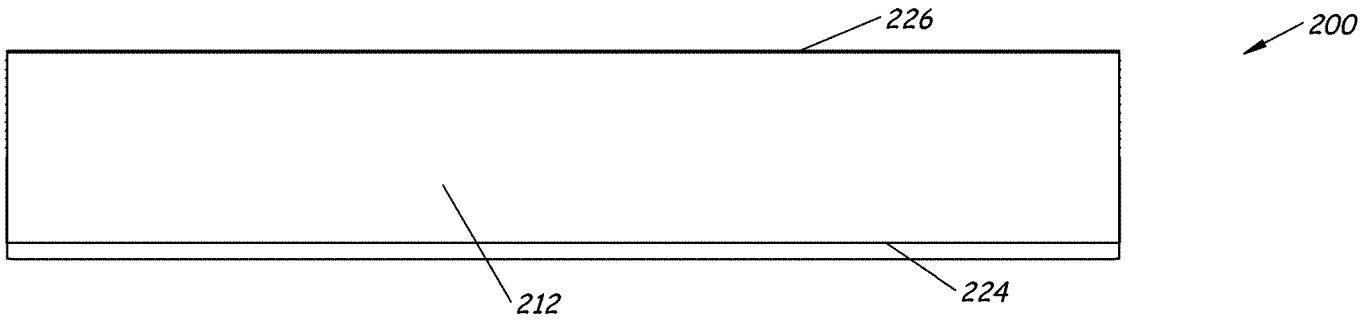
FIG. 16 is a top view of the file folder of FIG. 11.
Figure 17:
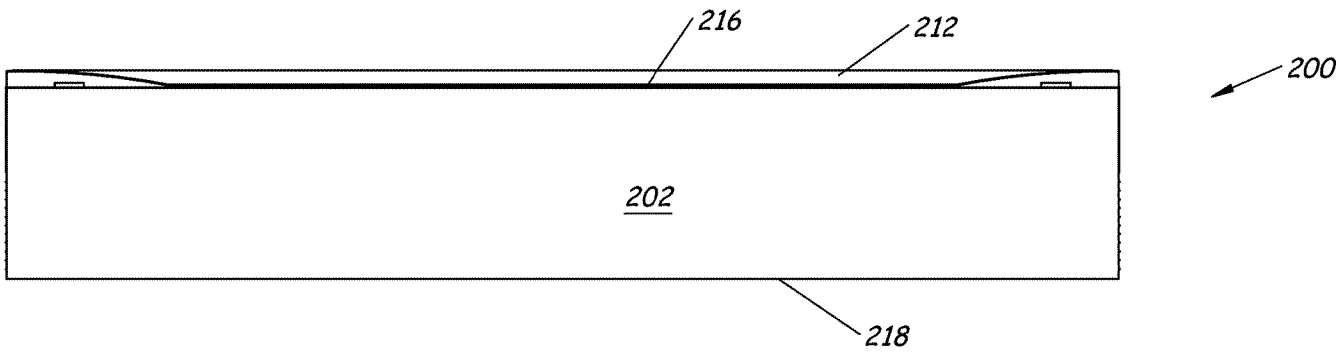
FIG. 17 is a bottom view of the file folder of FIG. 11.

In one embodiment, the pair of opposing sides 205 and 207 of expandable section 252 are made of a more flexible polymer than fixed section 250. In another embodiment, the pair of opposing sides 205 and 207 are gusseted. In this context, gusseted means the material of opposing sides 205 and 207 are folded, creased or otherwise hinged into triangular shapes, much like an accordion pleat, to provide the pair of opposing sides 205 and 207 with the ability to decrease in dimension and to increase in dimension. As illustrated in FIGS. 11 and 14, the pair of opposing sides 205 and 207 can be reinforced at their tops with nylon edging 228. Together, bottom 202, the pair of opposing sides 205 and 207, component 209 and back 210 can house a plurality of dividers and documents can be stored in between the plurality of dividers. Depending on how many documents are being stored in file folder 200, unfixed depth 283 can change using the gussets of the pair of opposing sides 205 and 207.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A file folder comprising:

a fixed section having fixed dimensions and defined by a closed bottom, an open top, and a pair of opposing sides, wherein the fixed section includes a fixed partition extending between the pair of sides and located between the closed bottom and the open top such that the fixed partition is spaced apart from the closed bottom and spaced apart from the open top;

a rotatable cover securable in a closed position to cover the open top of the fixed section and securable in an opened position to uncover the open top of the fixed section;

at least one pull-out drawer being slidable between a position located between the fixed partition and the closed bottom of the fixed section and a position that protrudes outwardly from one of the pair of opposing sides of the fixed section; and wherein the fixed section includes a storage compartment located between the fixed partition and the open top.

2. The file folder of claim 1, wherein the at least one pull-out drawer comprises a pair of pull-out drawers, wherein one of the pull-out drawers is slidable between the position located between the fixed partition and the closed bottom of the fixed section and the position that protrudes outwardly from one of the pair of opposing sides of the fixed section and wherein the other of the pull-out drawers is slidable between a position located between the fixed partition and the closed bottom of the fixed section and a position that protrudes outwardly from the other of the opposing sides of the fixed section.

3. The file folder of claim 1, wherein the at least one pull-out drawer is secured in the position located between the fixed partition and the closed bottom by at least one snap.

4. The file folder of claim 3, wherein the at least one pull-out drawer comprises a flap having a first portion of the snap and wherein a front of the fixed section comprises a second portion of the snap.

5. The file folder of claim 1, wherein the rotatable cover comprises a through cut that defines a closure tab.

6. The file folder of claim 5, further comprising a front slot extending through a front of the fixed section, the front slot configured to receive the closure tab to secure the rotatable cover in the closed position.

7. The file folder of claim 5, further comprising a back slot extending through a back of the file folder, the back slot configured to receive the closure tab to secure the rotatable cover in an opened position.

8. The file folder of claim 7, further comprising an expandable section located adjacent to the fixed section and having at least one unfixed dimension, wherein the back of the file folder comprises a back of the expandable section.

9. A file folder comprising:

a fixed section having fixed dimensions and defined by a closed bottom and an open top;

a rotatable cover securable in a closed position to cover the open top of the fixed section and securable in an opened position to uncover the open top of the fixed section, the rotatable cover having a through cut that defines a closure tab;

a front slot extending from an outer surface to an inner surface of a front of the file folder, the front slot configured to receive the closure tab on the rotatable cover to secure the rotatable cover in a closed position; and a back slot extending from an outer surface to an inner surface of a back of the file folder, the back slot configured to receive the closure tab on the rotatable cover to secure the rotatable cover in an opened position.

10. The file folder of claim 9, further comprising a fixed partition separating the closed bottom from the open top, wherein the front of the file folder comprises a front of the fixed section.

11. The file folder of claim 10, further comprising an expandable section located adjacent to the fixed section and having at least one unfixed dimension, wherein the back of the file folder comprises a back of the expandable section.

12. The file folder of claim 10, further comprising at least one pull-out drawer being slidable between a position located between the fixed partition and the closed bottom of the fixed section and a position that protrudes outwardly from a side of the fixed section.

13. The file folder of claim 10, wherein the fixed section includes a storage compartment located between the fixed partition and the open top.

14. The file folder of claim 9, wherein the through cut in the rotatable cover that defines the closure tab comprises an arcuate through cut.

15. The file folder of claim 9, wherein the rotatable cover including the closure tab comprise an outer surface and an inner surface, wherein in the closed position the closure tab is bent out-of-plane from a portion of the rotatable cover and received by the front slot in the front of the file folder so that the outer surface of the closure tab faces the inner surface of the front.

16. The file folder of claim 15, wherein in the opened position the closure tab is bent out-of-plane from the portion of the rotatable cover and received by the back slot in the back of the file folder so that the inner surface of the closure tab faces the inner surface of the back.

17. A method of accessing contents of a file folder, the method comprising:

providing a fixed section having fixed dimensions and defined by a closed bottom, an open top and a fixed partition separating the closed bottom from the open top, wherein a front of the file folder comprises a front of the fixed section;

removing a closure tab that is defined by a through cut in a rotatable cover from a front slot extending through the front of the file folder so as to release the rotatable cover from a secured closed position;

rotating the rotatable cover; and inserting the closure tab into a back slot extending through a back of the file folder so as to secure the rotatable cover in a secured open position.

18. The method of claim 17, further comprising sliding at least one pull-out drawer between a position located between the fixed partition and the closed bottom of the fixed section and a position that protrudes outwardly from a side of the fixed section.

19. The method of claim 17, wherein removing the closure tab that is defined by the through cut in the rotatable cover from the front slot further comprises removing the closure tab so as to allow the closure tab to return to a position that is in alignment with a portion of the rotatable cover.

20. The method of claim 19, wherein inserting the closure tab into the back slot extending through the back of the file folder so as to secure the rotatable cover in the secured open position comprises inserting the closure tab into the back slot by bending the closure tab out-of-plane from the portion of the rotatable cover so that an inner surface of the closure tab faces an inner surface of the back.

* * * * *